United States Patent [19]

Aiello et al.

[11] Patent Number: 5,006,130

[45] Date of Patent: Apr. 9, 1991

[54] GASOLINE COMPOSITION FOR REDUCING INTAKE VALVE DEPOSITS IN PORT FUEL INJECTED ENGINES

[75] Inventors: Robert P. Aiello, Cypress; Michael J. Riley; Herbert D. Millay, both of Houston, all of Tex.

[73] Assignee: Shell Oil Company, Houston, Tex.

[21] Appl. No.: 372,578

[22] Filed: Jun. 28, 1989

[51] Int. Cl.[5] ..... C10L 1/14

[52] U.S. Cl. ..... 44/432; 44/443; 123/1 A

[58] Field of Search ..... 44/62, 72, 77; 123/1 A

[56] References Cited

U.S. PATENT DOCUMENTS

| | | | |
|---|---|---|---|
| 2,786,745 | 3/1957 | Stayner et al. | 44/77 |
| 2,807,526 | 9/1957 | Foreman | 44/77 |
| 3,227,533 | 1/1966 | Gilland et al. | 44/77 |
| 3,438,757 | 4/1969 | Honnen et al. | 44/58 |
| 3,598,553 | 8/1971 | Rosenwald | 44/77 |
| 3,615,295 | 10/1971 | Manary, Jr. | 44/78 |
| 3,756,793 | 9/1973 | Robinson | 44/62 |
| 3,898,056 | 8/1975 | Honnen | 44/58 |
| 4,022,589 | 5/1977 | Alquist et al. | 44/58 |
| 4,039,300 | 3/1977 | Caloupek et al. | 44/58 |
| 4,357,148 | 11/1982 | Graiff | 44/62 |
| 4,810,263 | 3/1989 | Zimmerman | 44/72 |
| 4,877,416 | 10/1989 | Campbell | 44/62 |

FOREIGN PATENT DOCUMENTS 0290088 9/1988 European Pat. Off. .

*Primary Examiner*—Margaret B. Medley

[57] ABSTRACT

Intake valve deposits in port fuel injected engines are reduced by using a mixture of (a) of about 2.5 ppmw or higher of basic nitrogen in the form of an oil-soluble aliphatic alkylene polyamine containing at least one olefinic polymer chain, said polyamine having a molecular weight of about 600 to about 10,000, and (b) from about 75 ppmw to about 125 ppmw based on the fuel composition of certain oil-soluble olefinic polymers, poly(oxyalkylene) alcohol, glycol or polyol or mono or di ether thereof, non-aromatic oils or polyalpha olefins. The fuels are also compatible with carburetor and throttle body injected engines.

38 Claims, No Drawings

GASOLINE COMPOSITION FOR REDUCING INTAKE VALVE DEPOSITS IN PORT FUEL INJECTED ENGINES

FIELD OF THE INVENTION

The present invention relates to gasoline compositions for reducing intake valve deposits in port fuel injected engines.

BACKGROUND OF THE INVENTION

Gasoline compositions have traditionally been formulated to improve the performance of carburetor and throttle body injected engines. Beginning in about 1984, electronic port fuel injected engines were commonly introduced by automobile manufacturers. Shortly thereafter, in about 1985, problems began to be reported with intake valve deposits in electronic port fuel injected engines characterized by hard starting, stalls, and stumbles during acceleration and rough engine idle.

Accordingly, it would be desirable to have fuel compositions which reduced or eliminated such undesirable intake valve deposits in electronic port fuel inJected engines. Also, since some carburetor and throttle body injector engines will still be in use for the foreseeable future, it would be desirable if such fuels could also be compatible with these engines. Intake valve detergency is generally defined by the BMW NA standard of intake valve cleanliness for unlimited mileage, which is an established correlation of driveability and intake valve deposit weight of 100 milligrams or less.

Oil-soluble polyalkylene polyamines containing an olefinic polymer chain are known to improve detergent properties of fuels used in carburetor and throttle body type engines.

U.S. Pat. No. 3,756,793 discloses fuel compositions containing minor amounts of (1) a polyamine reaction product of a polyisobutenylchloride with an average molecular weight between 600–2500 and certain alkylene polyamines and (2) an organic substance with a viscosity between 20 and 2500 centistokes at 20° C. which is a polymer or copolymer or mixture thereof of hydrocarbons and hydrocarbons containing oxygen or oxygen and nitrogen. While it is stated at column 4, lines 59–61, that each additive can be present in the fuel at 0.001 to 0.1% w, the examples all illustrate only a polyoxypropylene glycol as (2) and the ratio by weight of (1) to (2) of 0.25 (Example I), and 0.29 (Example II). These fuels are described for only carburetor-type engines.

U.S. Pat. No. 4,357,148 discloses gasoline compositions containing (1) certain alkylene polyamines and (2) certain oil-soluble olefin polymers and copolymers. At column 5, lines 9–11, the concentration of the polyamine (1) is said to be about 6 to about 600 ppm and at column 2, line 35, that the concentration of the olefin (co)polymers (2) is 250–1200 ppm. In the examples the ratio of polyamine as basic nitrogen (1) to olefin (co)polymer as ppmw (2) is 0.00125 (Examples I–IV and VI), 0.005 (Example V), and 0.0015 (Example VII). The gasoline is only described for use in carburetor-type engines.

U.S. Pat. No. 3,438,757 discloses fuels containing certain hydrocarbylamines and polyamines. Minor amounts of certain nonvolatile lubricating mineral oils can be added to the gasoline. These additives were believed to act as carriers for the detergent in carburetor engines and to assist in removing or preventing deposits. However, the ratios of detergent to carrier in the table are only 0.05 to 0.125.

U.S. Pat. No. 4,022,589 discloses fuels containing a polybutene amine detergent and a larger amount of a solvent-refined paraffinic lubricating oil. These fuels are not disclosed for port fuel injected engines.

European patent 290,088, which corresponds to allowed U.S. patent application Ser. No. 190,196, now U.S. Pat. No. 4,846,848 discloses gasoline containing polyalphaolefin to reduce valve sticking in carburetor engines and its optional use with other additives, e.g., polyamines, in gasolines where the polyalphaolefin is the major additive. Use with electronic port fuel injected engines is not disclosed.

Such compositions, where the detergent is illustrated as a minor ingredient as compared to a second component oil, glycol, polymer or the like, have reduced effectiveness in electronic port fuel injected engines where the second component appears to act like a diluent, reducing the effectiveness of the detergent, which it had enhanced in carbureted engines. Accordingly, new unleaded fuel compositions are needed for the efficient operation of the new electronic port fuel injected engines.

SUMMARY OF THE INVENTION

The present invention is directed to an unleaded gasoline composition comprising a major amount of a hydrocarbon base fuel of the gasoline boiling range containing an effective amount of a mixture of (a) about 2.5 ppmw or higher of basic nitrogen based on the fuel composition in the form of an oil soluble aliphatic alkylene polyamine containing at least one olefinic polymer chain attached to a nitrogen and/or carbon atom of the alkylene radicals connecting the amino nitrogen atoms and said polyamine having a molecular weight in the range from about 600 to about 10,000 and (b) from about 75 ppmw to about 125 ppmw based on the fuel composition of at least one (carrier) component which is (i) a polymer of a $C_2$ to $C_6$ monoolefin, (ii) a copolymer of a $C_2$ to $C_6$ monoolefin, (iii) the corresponding hydrogenated polymer or copolymer, (iv) an oil soluble poly(oxyalkylene) alcohol, glycol or polyol or mono or di ether thereof, (v) a naphthenic or paraffinic oil having a viscosity at 100° C. of from about 2 to about 15 centistokes, or (vi) a polyalphaolefin having a viscosity at 100° C. of from about 2 to about 20 centistokes, the weight ratio of (a) as basic nitrogen to (b) in the mixture being in the range of about 0.0200 or higher.

The unleaded gasoline compositions of the invention, where the ratio of (a) to (b) is many times larger and the amount of (a) plus (b) is usually significantly less than has been utilized in the past few years in unleaded gasolines available for use in electronic port fuel injected engines, unexpectedly reduce intake valve deposits in electronic port fuel injected engines and the poor driveability which is characteristic of intake valve deposition in these engines. At the same time, the gasoline is compatible with carburetor and throttle body injected engines which are still in use.

The oil soluble aliphatic alkylene polyamine component detergent (a) has at least one polymer chain having a molecular weight in the range from about 500 to about 9,900 and preferably from about 550 to about 4,900, and particularly from 600 to 1,300, and which may be saturated or unsaturated and straight or branch chain and attached to a nitrogen and/or carbon atom of the alkylene radicals connecting the amino-nitrogen atoms.

Preferred polyolefin-substituted polyalkylene polyamines have the structural formula I

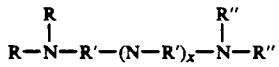

(I)

where R is selected from the group consisting of a hydrogen atom and a polyolefin having a molecular weight from about 500 to about 9,900, at least one R being a polyolefin group, R′ is an alkylene radical having from 1 to 8 carbon atoms, preferably 1 to 4 carbon atoms, R″ is hydrogen or lower alkyl, and x is 0–5. Preferred is when one R is a branch-chain olefin polymer and the other R is hydrogen. The molecular weight range of R is preferably 550 to 4,900, with a molecular weight range of 600–1300 being particularly preferred.

The olefinic polymers (R) which are reacted with polyamines to form the additive of the present invention include olefinic polymers derived from alkanes or alkenes with straight or branched chains, which may or may not have aromatic or cycloaliphatic substituents, for instance, groups derived from polymers or copolymers of olefins which may or may not have a double bond. Examples of non-substituted alkenyl and alkyl groups are polyethylene groups, polypropylene groups, polybutylene groups, polyisobutylene groups, polyethylene-polypropylene groups, polyethylene-poly-alpha-methyl styrene groups and the corresponding groups without double bonds. Particularly preferred are polypropylene and especially polyisobutylene groups.

The R″ group may be hydrogen but is preferably lower alkyl, i.e., containing up to 7 carbon atoms, and more preferably is selected from methyl, ethyl, propyl and butyl groups.

The polyamines used to form the aliphatic polyamine compounds of this invention include primary and secondary low molecular weight aliphatic polyamines such as ethylene diamine, diethylene triamine, triethylene tetramine, propylene diamine, butylene diamine, trimethyl trimethylene diamine, tetramethylene diamine, diaminopentane or pentamethylene diamine, hexamethylene diamine, heptamethylene diamine, diaminooctane, decamethylene diamine, and higher homologues up to about 18 carbon atoms. In the preparation of these compounds the same amines can be used or substituted amines can be used such as N-methyl ethylene diamine, N-propyl ethylene diamine, N,N-dimethyl 1,3-propane diamine, N-2-hydroxypropyl ethylene diamine, penta-(1-methylpropylene)hexamine, tetrabutylene-pentamine, hexa-(1,1-dimethylethylene)heptane, di-(1-methylamylene)-triamine, tetra-(1,3-dimethylpropylene)pentamine, penta-(1,5-dimethylamylene)hexamine, di(1-methyl-4-ethylbutylene)triamine, penta-(1,2-dimethyl-1-isopropyl ethylene)hexamine, tetraoctylenepentamine and the like.

Compounds possessing triamine as well as tetramine and pentamine groups are applicable for use because these can be prepared from technical mixtures of polyethylene polyamines, which could offer economic advantages.

The polyamine can be a cyclic polyamine, for instance, the cyclic polyamines formed when aliphatic polyamines with nitrogen atoms separated by ethylene groups were heated in the presence of hydrogen chloride.

An example of a suitable process for the preparation of the compounds employed according to the invention is the reaction of a halogenated polyhydrocarbon having at least one halogen atom as a substituent and a hydrocarbon chain as defined hereinbefore for R with a polyamine. The halogen atoms are replaced by a polyamine group, while hydrogen halide is formed. The hydrogen halide can then be removed in any suitable way, for instance, as a salt with excess polyamine. The reaction between halogenated hydrocarbon and polyamine is preferably effected at elevated temperature in the presence of a solvent; particularly a solvent having a boiling point of at least about 160° C.

The reaction between polyhydrocarbon halide and a polyamine having more than one nitrogen atom available for this reaction is preferably effected in such a way that cross-linking is reduced to a minimum, for instance, by applying an excess of polyamine.

The amine additive according to the invention can be prepared, for example, by alkylation of low molecular weight aliphatic polyamines. For instance, a polyamine is reacted with an alky or alkenyl halide. The formation of the alkylated polyamine is accompanied by the formation of hydrogen halide, which is removed, for example, as a salt of starting polyamine present in excess. With this reaction between alkyl or alkenyl halide and the strongly basic polyamines, dehalogenation of the alkyl or alkenyl halide can occur as a side reaction, so that hydrocarbons are formed as by-products. Their removal can, without objection, be omitted.

The amount of aliphatic polyamine used in the fuel will be sufficient that the basic nitrogen content of the fuel is in the range from about 2.5 or higher. As a matter of practicality, the basic nitrogen content is usually about 4.0 or below. This generally corresponds to concentration of (a) in the composition in the range from about 100 to about 160 ppm when (a) is a 1050 molecular weight aliphatic diamine, such as N-polyisobutenyl-N′,N′-dimethyl-1,3-diaminopropane. When using such a polyamine this corresponds to a weight ratio of (a) to (b) in the range of about 0.8 to 2.1. Highly effective results have been realized when the aliphatic polyamine is present in amounts sufficient to impart to the fuel a basic nitrogen in the range of from about greater than 2.5 to about 4.0 ppm, preferably from about 2.8 to about 3.2 ppm, and especially about 3.0 ppm.

Basic nitrogen content of the fuels of this invention is conveniently determined by a procedure requiring concentration by evaporating to near dryness, dilution of the residue with isooctane and potentiometric titration with alcoholic 0.1N hydrochloric acid. Add 1 gram of neutral mineral white oil, suitably "Nugol," to each replicate 75 gram sample of the fuel which is then evaporated on a steam plate under a stream of nitrogen gas to a residue of 1.5–3 grams. The residue is diluted with about 50 ml of isooctane, 10 ml of methyl ethyl ketone, 5 ml of chloroform and is tritrated with alcoholic standardized 0.01 to 0.05N hydrochloric acid (approximately 0.9 to 4.5 ml of concentrated HCl in 1 liter of anhydrous isopropyl alcohol) using a standard pH combination electrode with a ceramic-glass junction (Metrohm EA-120, Brinkman Instruments, Houston, Tex.) with a mettler SR-10 automatic trigger, in the equilibrium mode. Potentiometer meter readings are plotted against volume of the titration solution and the end point is taken as the inflection point of the resulting curve. A blank titration should be made on the fuel without the combination additive according to the invention. Basic nitrogen, ppmw, is calculated according to the following formula:

$$\text{Basic nitrogen, ppmw} = \frac{(V - b) \times n \times 14 \times 103}{w}$$

where

V = milliliters of HCl used to the inflection point b = milliliters of HCl used for blank to same inflection point n = normality of the HCl w = weight of gasoline sample.

For concentrations above 1 ppmw basic nitrogen, the value is the average triplicate determinations which do not differ by more than 0.3 ppmw.

In calculating the weight ration of (a) to (b) in the present compositions, the weight of the polyamine (a) is the basic nitrogen content basis, which simplifies calculations when dealing with polyamines of various molecular weights. The ratio of (a) to (b) is suitably from greater than about 0.0200 to about 0.0530, preferably from about 0.0300 to about 0.0400 and, especially, about 0.0300.

Component (b) can be a carrier for component (a) but its presence also aids the effectiveness of the gasoline for control of deposits and engine operation. Component (b) is preferably used at concentrations from about 90 to about 110 ppm.

The polymeric components (b i–iv) of the invention are well known in the art and patents related to their manufacture and use include, e.g., U.S. Pat. Nos. 2,692,257, 2,692,258, 2,692,259, 2,918,508 and 2,970,179, and their disclosures are incorporated herein by reference.

The polymers of monoolefins which are employed in the motor fuel of the invention are characterized by a number average molecular weight by osmometry in the range from about 500 to 1900 and preferably about 550 to 1500. Particularly preferred are those having said average molecular weight in the range from about 600 to about 950. Mixtures of polymers wherein a substantial portion of the mixture has a molecular weight above 1500 may be less effective. The polyolefins may be prepared from unsaturated hydrocarbons having from two to six carbon atoms including, e.g., ethylene, propylene, butylene, isobutylene, butadiene, amylene, isoprene, and hexene and the like.

Preferred for their efficiency and commercial availability are polymers of propylene and butylene; particularly preferred are polymers of isobutylene. Also suitable and part of this invention are derivatives resulting after hydrogenation of the above polymers.

Another component (b-iv) of the invention can be a polyoxyalkylene compound of the formula $R_1$—O—$(R_2O)_n$—$R_3$ wherein $R_1$ and $R_3$ each independently represents a hydrogen atom or an aliphatic, cycloaliphatic or aromatic hydrocarbon radical containing up to about 40 carbon atoms, $R_2$ represents an alkylene radical containing up to about 12 carbon atoms, and n represents an integer of at least about 7, preferably at least about 20 when $R_{20}$ is a 1,2-propylene group.

In the polyoxyalkylene chain —$(R_2O)_n$—, the group $R_2$ can be any alkylene radical, preferably an alkylene radical of 2 to 8 carbon atoms, especially an ethylene or 1,2-propylene group. The polyoxyalkylene chain can contain two or more dissimilar alkylene groups. These groups can be distributed randomly throughout the chain or can be arranged in a pre-determined pattern of units or blocks, each containing one or a plurality of oxyalkylene radicals.

In one embodiment of the invention, at least one of $R_1$ and $R_3$ is an alkyl or alkylphenyl group containing up to about 20 carbon atoms, for example, propyl, butyl, pentyl, hexyl, octyl, nonyl, decyl or dodecyl, or octylphenyl, nonylphenyl or the like. Preferably, $R_1$ is hydrogen and $R_3$ is an alkyl group, more preferably, $R_3$ is dodecyl or a mixture of alkyls from $C_{12}$ or $C_{15}$.

Suitable additives include polyoxypropylene glycols and the glycols containing both ethylene and 1,3-propylene groups in the polyoxyalkylene chain as well as the mono- and di-alkyl ethers of such glycols.

The commercially available polyoxyalkylene compounds are generally mixture of compounds in which the values for n and the molecular weight of such mixtures being only average values. The values of n of typical compounds are usually between 7 and 100, preferably between 8 and 80. The molecular weights vary between about 400 to about 6000, preferably about 500 to about 4000 and more preferably from about 1000–2000.

When the component (b) is b(v), it is a naphthenic or paraffinic oil having a viscosity at 100° C. of from about 2 to about 15 centistokes.

When the component (b) is b(vi), it is a polyalphaolefin having a viscosity at 100° C. of from about 2 to about 20 centistokes. Such polyalphaolefins are suitably hydrogenated oligomers derived from alphaolefenic monomers containing at least 6 carbon atoms. The hydrogenated oligomer itself preferably contains from about 18 to about 80 carbon atoms. Preferably the monomer contains 6 to 24 carbon atoms and especially 8 to 12 carbon atoms, while the oligomer preferably contains about 30 to about 80 carbon atoms. The preparation of these oligomers is described in *Hydrocarbon Processing*, Feb. 1982, beginning at page 75.

Mixtures, usually of equal amounts, of more than one kind of component b(i–vi), can be used. Preferably one component of the mixture is always b(iv).

The component (b) is preferably b(iv), a polyoxyalkylene alcohol, glycol or polyol and especially an ether thereof because it helps prevent low temperature intake valve sticking. Such a component is preferably used at about 80 to about 110 ppmw, and especially at about 100 ppmw.

Suitable liquid hydrocarbon fuels of the gasoline boiling range are mixtures of hydrocarbons having a boiling range of from about 25° C. (77° F.) to about 232° C. (450° F.) and comprise mixtures of saturated hydrocarbons, olefinic hydrocarbons and aromatic hydrocarbons. Preferred are gasoline blends having a saturated hydrocarbon content ranging from about 40 to about 80 percent volume, an olefinic hydrocarbon content from about 0 to about 30 percent volume and an aromatic hydrocarbon content ranging from about 10 to about 60 percent volume. The base fuel can be derived from straight run gasoline, polymer gasoline, natural gasoline, dimer or trimerized olefins, synthetically produced aromatic hydrocarbon mixtures from thermally or catalytically reformed hydrocarbons, or from catalytically cracked or thermally cracked petroleum stocks, and the like or mixtures of these. The hydrocarbon composition and octane level of the base fuel are not critical. The octane level, (R+M)/2, will generally be above 85. Any conventional motor fuel base may be employed in the practice of this invention. For example, in the gasoline hydrocarbons can be replaced by up to substantial amounts of conventional alcohols, or ethers, conventionally known for use in fuels. The base fuels are desirably substantially free of water, since water could impede a smooth combustion.

Normally, the hydrocarbon fuel mixtures to which the invention is applied are essentially lead-free, but can contain minor amounts of blending agents such as methanol, ethanol, methyl tertiary butyl ether, and the like, e.g., at from about 0.1 to about 15% volume of the base fuel. The fuels can also contain antioxidants such as phenolics, e.g., 2,6-di-tert-butylphenol or phenylenediamines, e.g., N,N'di-sec-butyl-p-phenylenediamine, dyes, metal deactivators, dehazers such as polyester-type ethoxylated alkylphenol-formaldehyde resins and the like. Corrosion inhibitors, such as a polyhydric alcohol ester of a succinic acid derivative having on at least one of its alpha-carbon atoms an unsubstituted or substituted aliphatic hydrocarbon group having 20 to 500 carbon atoms, for example, pentaerythritol diester of polyisobutylene-substituted succinic acid, the polyisbutylene group having an average molecular weight of about 950, in an amount of about 1 to 1000 ppmw. The fuels may also contain antiknock compounds such as a methyl cyclopentadienylmanganese tricarbonyl, orthoazidophenol and the like. The gasoline can also contain a dehazer, particularly a polyester-type alkoxylated alkylphenol-formaldehyde resin.

The additives of the present invention can be introduced into the combustion zone of the engine in a variety of ways to prevent buildup of deposits, or to accomplish reduction or modification of deposits. Thus, the additives can be injected into the intake manifold intermittently or substantially continuously, as described, preferably in a hydrocarbon carrier having a final boiling point (by ASTM D86) lower than about 232° C. (450° F.). A preferred method is to add the additives to the fuel. For example, the agent can be added separately to the fuel or blended with the other fuel additives. A concentrate can be prepared comprising a major amount of the additive mixture of the invention and a minor amount of a fuel compatible diluent boiling in the range of about 50° C. to 232° C.

The invention also provides a method for operating a port fuel injector engine on an unleaded fuel compatible with carburetor and throttle body injected engines which comprises introducing into an electronic port fuel injected engine with the combustion intake charge an effective amount of a mixture of (a) an oil soluble aliphatic alkylene polyamine and a second component (b) in the before-described amounts and ratios.

ILLUSTRATIVE EMBODIMENT

The invention will now be illustrated with reference to the following example which should not be regarded as limiting the invention in any way.

EMBODIMENT 1

Intake valve deposit tests were conducted in BMW 318i cars equipped with the 1.8-liter, four-cylinder engine, and were operated for 10,000 miles on the test fuel. Before the test started, deposits were removed from the cylinder head, intake manifold and piston tops and new intake valves were weighed and installed. The oil and filter were changed, new spark plugs installed and the fuel injectors flow checked. Mileage was accumulated on public roads using trained drivers. The test route consisted of about 10% city driving, 20% on secondary roads and 70% highway driving (maximum speed of 65 mph).

The primary test data are the intake valve deposit weights at the end of the 10,000-mile test. IVD weights are also determined at 5,000 miles, where tests can be terminated if the results are not promising. BMW's pass criteria are as follows: an average deposit weight of 100 milligrams per valve or less at the conclusion of the test meets BMW requirements for unlimited mileage acceptance: an average deposit weight of 250 mg per valve or less at the conclusion of the test meets BMW requirement for 50,000-mile service.

Table 1 lists the additive compositions used in premium unleaded base gasolines to which, in some tests, a dehazer was added, and the average intake valve deposit weights at the end of the test (10,000 miles).

TABLE 1

| Composition | Component (a)[1] ppm w/basic N | Component (b)[2] ppmw | Dehazer (d)[3] ppmw | Ratio (a)/(b) | BMW 318i Results Ave. Deposit w, mg |
|---|---|---|---|---|---|
| 1 | 160/4.0 | 100 | 0 | 0.0400 | 50 |
| 2 | 100/2.5 | 100 | 7 | 0.0250 | 100 |
| 3 | 128/3.2 | 80 | 9.6 | 0.0400 | 39 |
| 4 | 40/1.0 | 400 | 0 | 0.0025 | 350[4] |
| 5 | 20/0.5 | 500 | 7 | 0.0010 | 104[4] |

[1]Component (a) is N-polyisobutenyl-N',N'-dimethyl-1,3-diaminopropane MW = 1050.
[2]Component (b) is a polyisobutylene, MW = 650–750.
[3]Component (d) is dehazer.
[4]Not in accordance with the invention.

Results of these tests demonstrate that the gasoline compositions of the invention (1, 2, and 3) pass the BMW unlimited mileage test while employing significantly less total components (a) plus (b) and the ratio of (a) to (b) being higher by a factor of 10 or more than compositions 4 and 5 which are not in accordance with the invention.

EMBODIMENT 2

The test procedures described in Embodiment 1 above were repeated except that the component (b) was a polyoxypropylene glycol mono ether of a mixed $C_{12}$–$C_{15}$ alcohol of average molecular weight 1400. The results shown below in Table 2 demonstrate the gasoline composition passed the BMW unlimited mileage test and that little deposit accumulated.

TABLE 2

| Composition | Component (a)[1] ppm w/basic N | Component (b)[2] ppmw | Dehazer (d)[3] ppmw | Ratio (a)/(b) | BMW 318i Results Ave. Deposit w, mg |
|---|---|---|---|---|---|
| 6 | 120/3.0 | 100 | 12 | 0.03 | 25 |

Embodiment 3

The test procedures described in Embodiment 1 above were repeated except that the component (b) was a high viscosity naphthenic oil of the invention. The results shown below in Table 3 demonstrate that the gasoline compositions passed the BMW unlimited mileage or 50,000-mile service tests.

TABLE 3

| Composition | Component (a)[1] ppm w/basic N | Component (b)[2] ppmw | Dehazer (d)[3] ppmw | Ratio (a)/(b) | BMW 318i Results Ave. Deposit w, mg |
|---|---|---|---|---|---|
| 7 | 160/4.0 | 100 | 12 | 0.0400 | 89 |
| 8 | 128/3.2 | 80 | 9.6 | 0.0400 | 128 |

EMBODIMENT 4

The test procedure utilized three BMW 325 automobiles. Prior to testing, the engines of these automobiles were equipped with new, weighed intake valves. Mileage was accumulated on Road Simulation Chassis Dynamometers using a driving cycle developed by BMW AG. At the completion of the test, the intake valves were removed and rated, by the BMW rating scale, for deposit buildup in the tulip area. The deposits were then removed from the face of the valves and the valves were weighed to determine deposit accumulation. Unleaded premium base gasoline, to which 7–12 ppmw of dehazer was added, was used in these tests.

Results of the tests conducted are given in Table 4 below.

TABLE 4

| Composition | Component (a)[1] ppm w/basic N | Component (b)[2] ppmw | Ratio (a)/(b) | BMW 325 Results Ave. Deposit w, mg |
|---|---|---|---|---|
| 9 | 100/2.5 | 100 | 0.0250 | 183 |
| 10 | 120/3.0 | 100 | 0.0300 | 43 |
| 11 | 160/4.0 | 100 | 0.0400 | 95 |
| 12 | 60/1.5 | 400 | 0.0038 | 469[3] |
| 13 | 76/1.9 | 500 | 0.0038 | 346[3] |

[1]Component (a) is N-polyisobutenyl-N',N'-dimethyl-1,3-diaminopropane MW = 1050.
[2]Component (b) is a polyisobutylene of MW = 650–750.
[3]Not in accordance with invention.

EMBODIMENT 5

The test procedures described in Embodiment 4 above were repeated except that (b) was either a medium viscosity index oil (MVI) or a high viscosity index oil (HVI). The results of these tests are set forth in Table 5 below and demonstrate that the MVI oil of the invention gave good deposit control as compared to when a large excess of an HVI oil was used, resulting in a gasoline composition outside the invention.

TABLE 5

| Composition | Component (a) ppm w/basic N | Component (b) ppmw | Ratio (a)/(b) | BMW 325 Results Ave. Deposit w, mg |
|---|---|---|---|---|
| 14 | 160/4.0 | 100 MVI | 0.0400 | 72 |
| 15 | 140/3.6 | 1000 HVI | 0.0036 | 248* |

*Not in accordance with the invention.

EMBODIMENT 6

The test procedures described in Embodiment 4 above were repeated except that a 50/50 by weight mixture of the polyisobutylene with a medium viscosity index 400 neutral naphthenic oil was used as component (b). The results of the test are shown below in Table 6 and demonstrate that the gasoline composition gave excellent deposit control.

TABLE 6

| Composition | Component (a) ppm w/basic N | Component (b) ppmw | Ratio (a)/(b) | BMW 325 Results Ave. Deposit w, mg |
|---|---|---|---|---|
| 16 | 160/4.0 | 50/50 | 0.0400 | 12 |

EMBODIMENT 7

Cold start valve sticking tests with a 100-mile conditioning cycle were run in 1988 Chevrolet pickups equipped with 5.0L V8 TBI engines using a gasoline composition comprising a single, double or triple dose of an additive mixture comprising 3.0 ppmw basic nitrogen in additive (a) N-polyisobutenyl-N',N'-dimethyl-1,3-diaminopropane, and various amounts of a polyoxypropylene mono ether of a mixed $C_{12}$–$C_{15}$ alcohol of average molecular weight 1400 as additive (b). High mileage cold start valve sticking tests to 10,000 miles were run in the same pickups using additive (a) and 100 ppmw of additive (b). Results of these tests illustrated that gasoline containing additive (a) and 100 ppmw of additive mixture (b) provides satisfactory cold start properties. In similar high mileage tests with only 25 ppmw of (b), valve sticking was at a rate higher than acceptable.

What is claimed is:

1. An unleaded fuel composition comprising a major amount of a hydrocarbon base fuel of the gasoline boiling range containing an effective amount to reduce intake valve deposits in electronic port fuel injected engines of a mixture of (a) about 2.5 ppmw or higher of basic nitrogen based on the fuel composition in the form of an oil soluble aliphatic alkylene polyamine containing at least one olefinic polymer chain attached to at least one nitrogen or carbon atom of the alkylene radical connecting the amino nitrogen atoms and said polyamine having a molecular weight in the range of from about 600 to about 10,000 and (b) from about 75 ppmw to about 125 ppmw based on the fuel composition of at least one component selected from (i) a polymer of a $C_2$ to $C_6$ monoolefin, (ii) a copolymer of a $C_2$ to $C_6$ monoolefin, (iii) the corresponding hydrogenated polymer or copolymer, (iv) an oil soluble poly(oxyalkylene) alcohol, glycol or polyol or a mono or di ether thereof, which has the formula $R_1$—O—$(R_2O)_n$—$R_3$ wherein $R_1$ and $R_3$ each independently is a hydrogen atom or an aliphatic, cycloaliphatic or mononuclear aromatic hydrocarbon group of up to 40 carbon atoms, $R_2$ represents an alkylene group and n is an integer of at least 7, (v) a naphthenic or paraffinic oil having a visocity of 100° C. of from about 2 to about 15 cenetistokes, the weight ratio of (a) as basic nitrogen to (b) in the mixture being in the range of about 0.020 or higher.

2. The composition according to claim 1 wherein said component (a), the aliphatic polyamine, has the structural formula I $$R-\overset{\overset{\displaystyle R}{|}}{N}-R'-(N-R')_x-\overset{\overset{\displaystyle R''}{|}}{N}-R'' \qquad (I)$$

where R is selected from the group consisting of a hydrogen atom and a polyolefin having a molecular weight from about 550 to about 4900, at least one R being a polyolefin group, R' is an alkylene radical having from 1 to 8 carbon atoms, R'' is hydrogen or lower alkyl and x is 0 to 5.

3. The composition according to claim 2 wherein in said structural formula, one R is hydrogen and one R is selected from the group consisting of polypropylene and polyisobutylene having a molecular weight from about 600 to 1300.

4. The composition according to claim 3 wherein one R is a polyisobutylene group and the other is hydrogen.

5. The composition according to claim 4 wherein each R' is independently an alkylene group containing from 1 to 4 carbon atoms, each R'' is independently an alkyl group containing 1 to 4 carbon atoms and x is 0 to 2.

6. The composition according to claim 5 wherein R' is propylene, each R'' is a methyl group and x is 0.

7. The composition according to any one of claims 1 to 6 wherein (b) is a polymer of a $C_3$ or $C_4$ monoolefin having a molecular weight in the range from about 600 to about 950.

8. The composition according to any one of claims 1 to 6 wherein (b) is an oil soluble poly(oxyalkylene) alcohol, a glycol or polyol or mono or di ether thereof.

9. The composition according to claim 8 wherein in the polyoxyalkylene chain —$(R_2O)_n$—, $R_l$ is an alkyene group containing 2 to 8 carbon atoms.

10. The composition according to claim 9 wherein $R_2$ is an ethylene or 1,2-propylene group.

11. The composition according to claim 10 wherein $R_2$ is a 1,2 propylene group.

12. The composition according to claim 9 wherein at least one of $R_1$ and $R_3$ is an alkyl or alkylphenyl group containing up to 20 carbon atoms.

13. The composition according to claim 12 wherein $R_1$ is hydrogen and $R_3$ is an alkyl group.

14. The composition according to claim 12 wherein $R_3$ is dodecyl or a mixture alKyl from $C_{12}$ to $C_{15}$.

15. The composition according to claim 14 wherein $R_2$ is an ethylene or 1,2-propylene group.

16. The composition according to any one of claims 1 to 6 wherein (b) is a naphthenic or paraffinic oil.

17. The composition according to any one of claims 1 to 6 wherein (a) is present from about greater than 2.5 ppmw to about 4.0 ppmw basic nitrogen, (b) is present in about 75 ppmw to about 125 ppmw and the ratio of (a) to (b) is from about greater than 0.0200 to about 0.0530.

18. A composition according to claim 17 wherein (a) is present from about 2.8 to about 3.2 ppmw basic nitrogen, (b) is present in about 80 to about 100 ppmw and the ratio of (a) to (b) is from about 0.0300 to about 0.0400.

19. A composition according to claim 18 wherein (a) is present at about 3.0 ppmw basic nitrogen, (b) is present at about 100 ppmw and the ratio of (a) to (b) is about 0.0300.

20. A method for operating an electronic port fuel injected engine on an unleaded fuel compatible with carburetor and throttle body injected engines which comprises introducing into an electronic port fuel injected engine with the combustion intake charge an effective amount to reduce intake valve deposits in the electronic port fuel injected engine of a mixture of (a) about 2.5 ppmw or higher of basic nitrogen based on the fuel composition in the form of an oil soluble aliphatic alkylene polyamine containing at least one olefinic polymer chain attached to at least one nitrogen or carbon atom of the alkylene radical connecting the amino nitrogen atoms and said polyamine having a molecular weight of from about 600 to about 10,000; and (b) from about 75 ppmw to about 125 ppmw based on the fuel composition of at least one component selected from (i) a polymer of a $C_2$ to $C_6$ monoolefin, (ii) a copolymer of a $C_2$ to $C_6$ monoolefin, (iii) the corresponding hydrogenated polymer or copolymer, (iv) an oil soluble poly(oxyalkylene) alcohol, glycol or polyol or a mono or di ether thereof, ether thereof, which has the formula $R_1$—O—$(R_2O)_n$—$R_3$ wherein $R_1$ and $R_3$ each independently is a hydrogen atom or an aliphatic, cycloaliphatic or mononuclear aromatic hydrocarbon group of up to 40 carbons atoms, $R_2$ represents an alkylene group and n is an integer of at least 7, and (v) a naphthenic or paraffinic oil having a viscosity at 100° C. of from about 2 to about 15 centistokes, the weight ratio of as basic nitrogen to (b) in the mixture being in the range of about 0.0200 or higher.

21. The method according to claim 20 wherein said component (a), the aliphatic polyamine, has the structural formula I

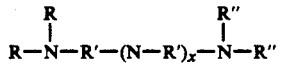

(I)

where R is selected from the group consisting of a hydrogen atom and an polyolefin having a molecular weight from about 550 to about 4900, at least one R being a polyolefin group, R′ is an alkylene radical having from 1 to 8 carbon atoms, R″ is hydrogen or lower alkyl and x is 0 to 5.

22. The method according to claim 21 wherein in said structural formula, one R is hydrogen and one R is selected from the group consisting of polypropylene and polyisobutylene having a molecular weight from about 600 to 1300.

23. The method according to claim 22 wherein one R is a polyisobutylene group and the other is hydrogen.

24. The method according to claim 23 wherein each R′ is independently an alkylene group containing from 1 to 4 carbon atoms, each R″ is independently an alkyl group containing 1 to 4 carbon atoms and x is 0 to 2.

25. The method according to claim 24 wherein R′ is propylene, each R″ is a methyl group and x is 0.

26. The method according to any one of claims 21 to 25 wherein (b) is a polymer of a $C_3$ or $C_4$ monoolefin having a molecular weight in the range from about 600 to about 950.

27. The method according to any one of claims 21 to 25 wherein (b) is an oil soluble poly(oxyalkylene) alcohol, a glycol or polyol or mono or di ether thereof.

28. The method according to claim 26 wherein in the polyoxyalkylene chain $-(R_2O)_n-$, $R_2$ is an alkylene group containing 2 to 8 carbon atoms.

29. The method according to claim 28 wherein $R_2$ is an ethylene or 1,2-propylene group.

30. The method according to claim 29 wherein $R_2$ is a 1,2-propylene group.

31. The method according to claim 28 wherein at least one of $R_1$ and $R_3$ is an alkyl or alkylphenyl group containing up to 20 carbon atoms.

32. The method according to claim 31 wherein $R_1$ is hydrogen and $R_3$ is an alkyl group.

33. The method according to claim 31 wherein $R_3$ is dodecyl or a mixture alkyl from $C_{12}$ to $C_{15}$.

34. The method according to claim 33 wherein $R_2$ is an ethylene or 1,2-propylene group.

35. The method according to any one of claims 21 to 25 wherein (b) is a naphthenic or paraffinic oil.

36. The method according to any one of claims 21 to 25 wherein (a) is present from about greater than 2.5 ppmw to about 4.0 ppmw basic nitrogen, (b) is present in about 75 ppmw to about 125 ppmw and the molecular weight ratio of (a) to (b) is from about greater than 0.020 to about 0.053.

37. The method according to claim 36 wherein (a) is present from about 2.8 to about 3.2 ppmw basic nitrogen, (b) is present in about 80 to about 110 ppmw and the ratio of (a) to (b) is from about 0.0300 to about 0.0400.

38. The method according to claim 37 wherein (a) is present at about 3.0 ppmw basic nitrogen, (b) is present at about 100 ppmw and the ratio of (a) to (b) is about 0.0300.

* * * * *